United States Patent [19]

Wickoren

[11] Patent Number: 4,904,159

[45] Date of Patent: Feb. 27, 1990

[54] PUMP IMPELLER

[75] Inventor: Dean R. Wickoren, Paola, Kans.

[73] Assignee: Suburbia Systems, Inc., Olathe, Kans.

[21] Appl. No.: 221,031

[22] Filed: Jul. 18, 1988

[51] Int. Cl.[4] ..... F04D 7/04

[52] U.S. Cl. ..... 416/183; 415/121.1

[58] Field of Search ..... 416/183, 235; 415/121 B, 121.1

[56] References Cited

U.S. PATENT DOCUMENTS

| | | | |
|---|---|---|---|
| 224,870 | 2/1880 | Bush | 416/183 X |
| 438,606 | 10/1890 | Currier | 416/235 X |
| 1,161,701 | 11/1915 | May | 416/235 |
| 2,343,714 | 3/1944 | Swenson | 415/121 BX |
| 3,147,911 | 9/1964 | Clute | 416/183 |
| 3,260,443 | 7/1966 | Garnett et al. | 416/183 X |
| 3,637,196 | 1/1972 | Kaelin | 416/183 X |
| 3,971,513 | 7/1976 | Klip | 415/121 BX |
| 4,074,953 | 2/1978 | Budde et al. | 416/183 |

FOREIGN PATENT DOCUMENTS

| | | | |
|---|---|---|---|
| 43745 | 2/1931 | Denmark | 416/235 |

OTHER PUBLICATIONS

Versi-Dredge 3000, Advertising Flyer of Innovative Material Systems, a Division of Suburbia Systems.

Versi-Dredge 3000, Advertising Flyer of Innovative Material Systems, a Division of Suburbia Systems.

Photograph of Prior Pump Impeller of Suburbia Systems.

*Primary Examiner*—Everette A. Powell, Jr.

*Attorney, Agent, or Firm*—Hovey, Williams, Timmons & Collins

[57] ABSTRACT

A pump impeller especially useful for moving heavy sediment and debris includes a drive plate having a series of blades mounted on one side thereof and radially extending from the center of the drive plate. Each of the blades is provided with a material retainer secured to the leading edge of the blade in the form of a winglet. The winglet forces the sediment and debris outwardly to be driven by the leading edge and across the tip of the blade. Each of the top or inlet edges of the blades is sharpened to cut weeds or debris which may then be pumped with the sediment.

6 Claims, 2 Drawing Sheets

PUMP IMPELLER

BACKGROUND OF THE INVENTION

1. Field of the Invention

This invention relates to an impeller blade for pumps which is particularly adapted for moving large quantities of heavy sediment in settling ponds.

2. Description of the Prior Art

Pumps for moving large volumes of waste water are generally of a centrifugal flow design. Centrifugal pumps move fluids by accelerating it radially outward. Centrifugal pumps consist basically of one or more rotating impellers in a stationary housing which guides the fluid from an inlet to an outlet location which is generally outward from the inlet. The rotating impeller imparts kinetic energy and pressure to the fluid being pumped, and the fluid pumped is in turbulent flow in the pump.

Impeller pumps have heretofore been used for pumping fluids from settling ponds and the like. Conventional impellers have been useful in pumping liquids and light sedimentary materials. It has heretofore been diffcult to pump heavy sediment, which contains little water, through centrifugal pumps because of the high viscosity of the sediment, the friction of the impeller blade through the sediment, and the need to operate the pump at a satisfactory speed to achieve an effective rate of flow.

The problems presented in pumping slurries and semi-solids such as sludge and sediment are increased when the material to be pumped includes a high volume of solids. In the case of a series of settling ponds, the last pond often has sediment which may be extremely thick and includes a large amount of debris such as weeds and trash of every conceivble variety. This material requires the pump impeller to rotate at a fairly low speed, with the result that heavy material tends to fall out of open inlet pumps. On the other hand, recessed impeller pumps must operate at lower heads and pressures on such heavy sediment and do not effectively force both the water and solids to the tip of the blade where the highest velocity is achieved.

SUMMARY OF THE INVENTION

The problems outlined above are in large measure solved by the radial fan pump impeller in accordance with the present invention. That is, the pump impeller disclosed herein permits the pumping of industrial and municipal sludge, heavy sediment, debris, coal fine, fly ash and the like at satisfactory volumes. Additionally, the pump impeller hereof may be run at speeds resulting in constant cavitation behind the blades and nevertheless is provided with some laminar flow characteristics because the fluid is pushed.

In accordance with these objects, the pump impeller hereof comprises a plurality of radially extending blades mounted on a rotatable drive plate, with the leading face of each of the blades being provided with a retaining winglet for retaining material to be pumped against the blade during its rotation. The inlet-side edges of the blades are sharpened for severing debris as it passes thereover, with the retaining winglets extending from the leading face of the blades in the direction of rotation. The winglets force both the water and sludge over the tip of the blade where the velocity within the pump is greatest, with the water carrying the sludge over the tip. Large, tough weeds, rope and the like may thereby be pumped with the remaining sediment and fluid to a pipe or conduit for ultimate discharge.

DETAILED DESCRIPTION OF THE PREFERRED EMBODIMENT

Figure 1:
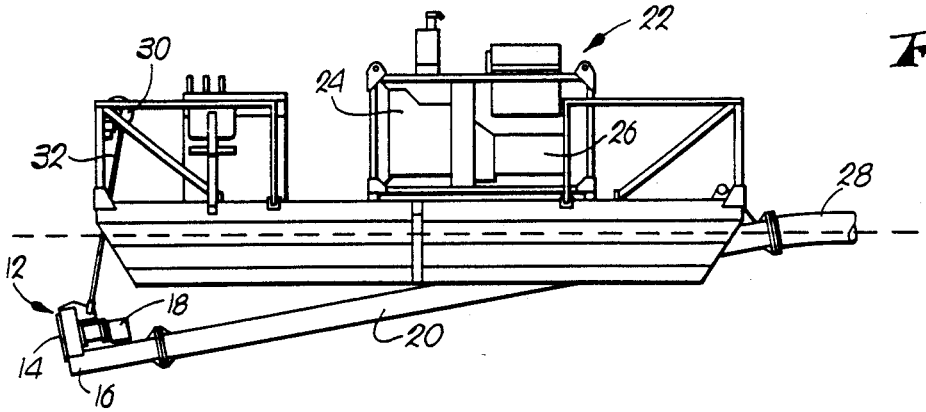
FIG. 1 is an elevational view of a floating dredge for pumping sludge and the like in settling ponds.
Figure 2:
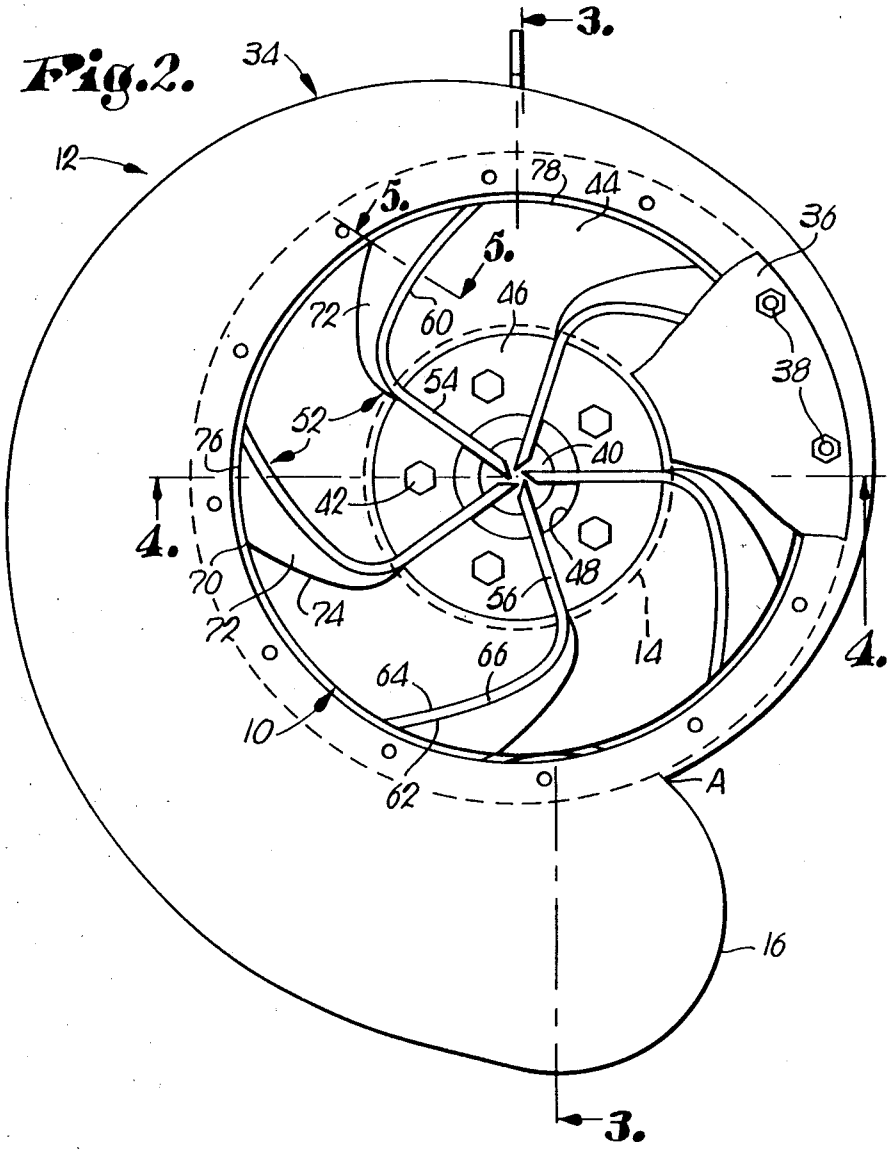
FIG. 2 is a front elevational view of the inlet side of a pump employing the impeller, with a portion of the face plate surrounding the pump inlet broken away and shown by a dashed line.

Referring now to FIG. 2 of the drawing, an impeller 10 is adapted to be mounted in a centrifugal pump 12 having an inlet 14 and outlet 16. The pump 12 is driven by a hydraulic motor 18 and is mounted, with motor 18, on pipe 20, as shown in FIG. 1. The outlet 16 is in communication with pipe 20 for the transmittal of pumped sludge or sediment therethrough.

The specific application shown in FIG. 1 is for use with a floating dredge 22, where a diesel engine 24 is coupled to a hydraulic fluid pump 26 for providing hydraulic power through a conduit to the motor 18. The pipe 20 is connected to a flexible hose 28 for discharging sludge or sediment to a remote location. A windlass 30 is connected to the pump 12 by a cable 32 for adjusting the depth of the pump 12 in the settling pond.

Figure 3:
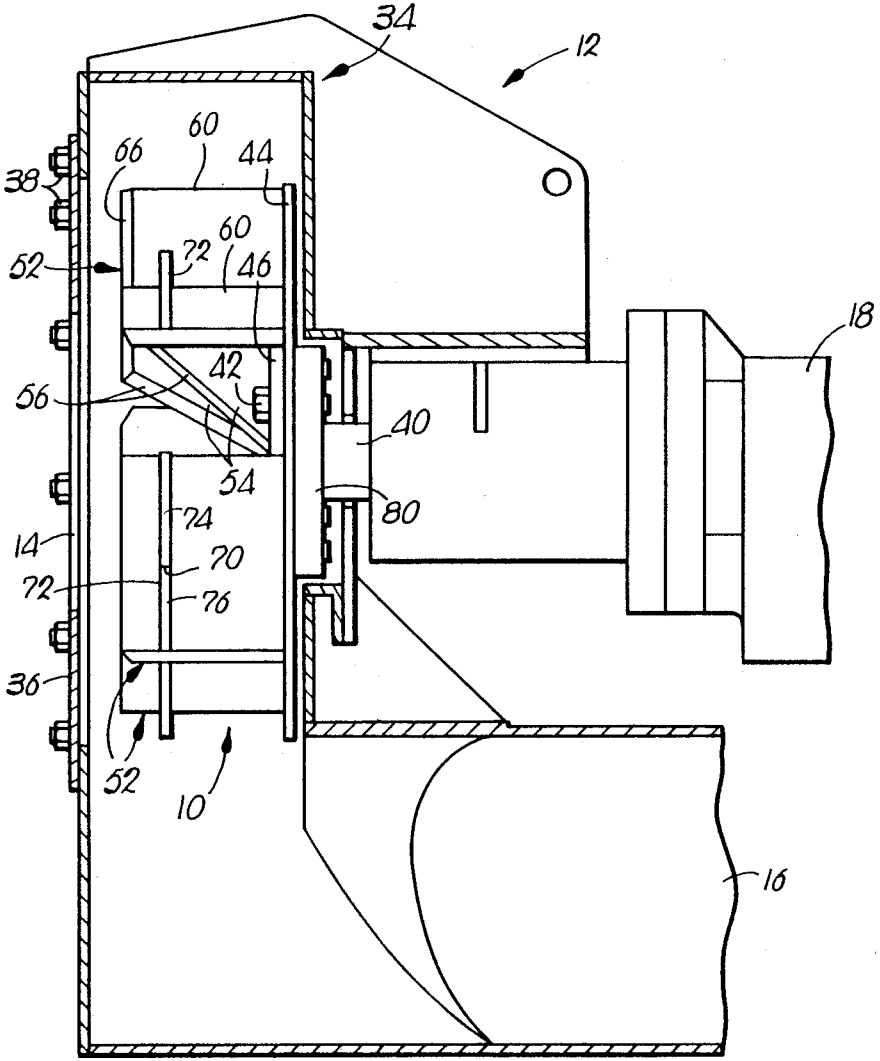
FIG. 3 is a fragmentary vertical sectional view taken along line 3—3 of FIG. 2, which shows the mounting of the impeller blade within the pump housing.

As shown in FIGS. 2 and 3, the pump 12 includes housing 34, which is provided with a face plate 36 surrounding the inlet 14. The face plate 36 is secured by bolts 38 or other suitable means so that it may be replaced with wear. A fragmentary portion of the face plate 36 is shown in FIG. 2 with the remainder cut away for clarity. The dashed lines in FIG. 2 represent the remainder of the face plate 36 with the inlet 14 defined by the center opening of the annular face plate 36. The housing 34 is roughly in the shape of an involute, as shown in elevation in FIG. 2, with the distance between the impeller 10 and the housing 34 increasing from point A to outlet 16.

Impeller 10 is removably mounted to shaft 40 by a series of bolts 42 extending through holes in a drive plate 44 and backing plate 46. The drive plate 44 has first and second sides thereof and a geometric center, with the backing plate 46 attached to the drive plate 44 on a first, inlet side and centered on the drive plate 44. The drive plate 44 and backing plate 46 are in the form of annular discs defining openings 48 in the center of each. The openings 48, drive plate 44, and backing plate 46 are most visible in FIG. 6.

The impeller 10 also includes a plurality of radially extending blades 52 extending outwardly for propelling material through the pump 12. In the preferred embodiment, the blades 52 include a relatively flat, triangular first component 54 extending radially outward from the center of the impeller 10. The first component 54 is provided with a chamfered, sharpened top marginal edge 56 facing inlet 14 and is of increasing depth corresponding to the distance of the component 54 from the center C. The first components 54 are welded or otherwise rigidly joined to the first, inlet side of backing plate 46 at their bottom marginal edge 58 and meet at the geometric center C of the drive plate 44.

The second, outboard blade component 60 is curved away from the direction of rotation of the impeller 10. The second component 60 includes a leading face 62 and trailing face 64, a top edge 66 facing inlet 14 which is chamfered on the trailing face 64 to present a sharpened top edge 66 thereon and a bottom edge 68 which is rigidly fastened by welding or the like to the first, inlet side of drive plate 44. The second component 60 also includes a tip 70 at the outward portion thereof.

A winglet 72 is secured to leading face 62, intermediate drive plate 44 and top edge 66 on second component 60. Winglet 72 extends in the direction of rotation of the impeller 10 and is substantially parallel to drive plate 44 and normal to face 62. The winglets 72 are relatively flat, conform to the leading face 62 to which they are attached, and are curved away from the direction of rotation of the impeller 10 at the leading edge 74, but to a lesser extent than second component 60 so that the width of the winglet increases with the radial distance from the center of the drive plate 44.

Winglet 72 also has an outer margin 76 which is spaced above and conforms in shape to the margin 78 of the drive plate 44.

In operation, hydraulic motor 18 rotates shaft 40, which is coupled to impeller 10 by bolts 42 inserted through aligned holes in drive plate 44 and backing plate 46. The shaft 40 is preferably threadably attached to a hub 80 through which the bolts 42 are also inserted.

Figure 6:
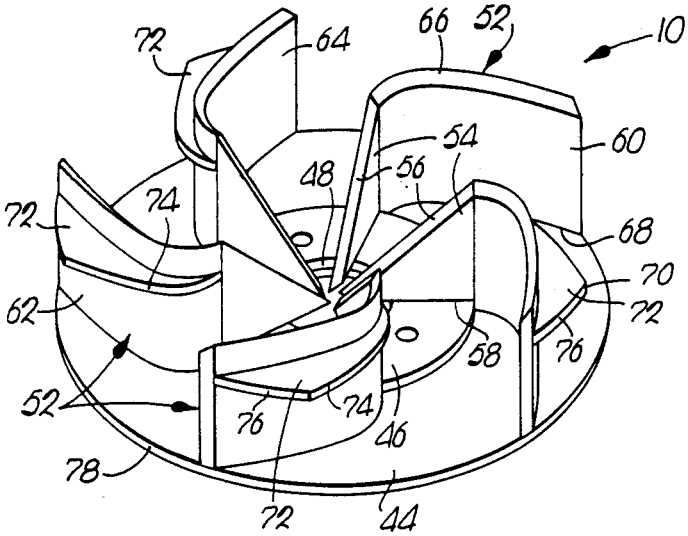
FIG. 6 is a perspective view of the impeller blade.

When the hydraulic motor 18 is energized, the shaft 40 turns the impeller 10 so that the leading face 62 of each of blades 52 is facing in the direction of rotation which is counter-clockwise viewing FIGS. 2 and 6. In the application shown in FIG. 1, the impeller 10 is a component of a pump 12 which is used to pump sediment and sludge from floating dredge 22 to a remote location. The pump 12 is lowered by windlass 30 through the water until the pump 12 contacts the bottom where the sludge has settled. The sludge enters pump 12 through inlet 14 defined by face plate 36. As noted earlier, such sludge may include not only sediment but thick weeds and trash such as tennis shoes, clothing, tools and marine parts.

As the impeller 10 rotates, the heavy sludge is pushed outward along blades 52. The sediment is carried outward along leading faces 62 by the water therein. The velocity of the sludge and other material is increased as it is pushed outwardly and forwardly along leading face 62 of blade 52. The impeller structure permits the impeller 10 to be rotated at sufficient speed to agitate and thus in effect "liquify" the sedimentary sludge. Yet further, the impeller 10 may rotate fast enough to have 100% cavitation behind the trailing face 64 without damage to the impeller 10 or housing 34.

The winglet 72 limits the transverse movement of water and sludge in a direction from the drive plate 44 toward the top edge 66 across the blades during rotation of the impeller 10 and permits an improved, laminar flow for the heavy sludge. The path of the sludge is thus substantially linear and outward and across blades 52. The sharpened top marginal edge 56 and top edge 66 of each of blades 52 causes weeds and other debris to be severed for better passage through the pump 12. The blades 52 act as a radial fan to push the sludge and debris outwardly toward outlet 16, where the pressure and kinetic energy drive the sludge and debris through pipe 20 to conduit 28.

Figure 4:
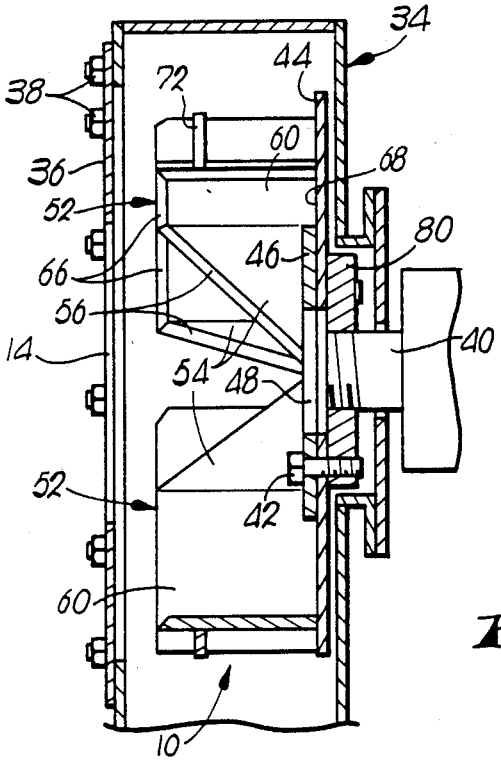
FIG. 4 is a horizontal sectional view taken along line 4—4 of FIG. 2 showing the impeller mounted to a pump shaft.
Figure 5:
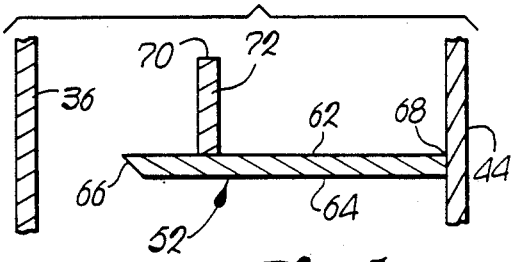
FIG. 5 is a fragmentary sectional view along 5—5 of FIG. 2 showing the configuration of the blade and winglet.

As may be seen in FIGS. 2 and 4, the top edges 56 and 66 of each blade 52 are spaced apart from housing 34 so that some materials need only be cut enough to fit the uncut part between the inlet end of the impeller 10 and the housing 34 of the pump 12. However, as the space between top edges 56 and 66 and the housing 34 is increased to accommodate larger sized debris, the flow of the sludge becomes less laminar and more turbulent and pump efficiency is reduced. The winglets 72 are primarily intended to pass through the sludge and debris and retain it against the blade, although some size reduction might take place. Without the winglet 72, the edges 56 and 66 would cut the material but could not hold the water carrying the sludge and debris against the blade 52 for passage outwardly along blade 52.

I claim:

1. An impeller for pumping highly viscous liquids comprising:

a substantially circular drive plate having first and second sides, a geometric center, and a marginal edge, said drive plate being adapted for rotation within a pump housing;

a plurality of symmetrical, evenly spaced blades extending radially outwardly to present a tip, each of said blades being connected only to said drive plate and extending substantially normal thereto to present a sharpened top edge opposite said drive plate, each of said blades including a leading face corresponding to the direction of rotation of said impeller during operation and a trailing face oriented away from a direction of rotation of said impeller during operation thereof, each of said blades including winglet means secured to the leading face thereof and located intermediate said top edge and said drive plate and positioned more proximate to said top edge than to said drive plate, said winglet being oriented substantially parallel to said drive plate and extending outwardly to said tip to inhibit the flow of said liquid to said top edge during pumping of said highly viscous liquid.

2. An impeller as set forth in claim 1, each of said blades including first and second components, said first component being relatively flat and extending radially outwardly from adjacent said geometric center, said second component extending radially outwardly from said first component to said tip and being curved rearwardly with respect to the desired direction of rotation of said impeller.

3. A pump impeller as set forth in claim 2 wherein the height of said first component increases as the first component extends radially from the center of said plate.

4. An impeller as set forth in claim 2, wherein said winglet means are secured to said second component, said winglet means increasing in width along said second component corresponding to increasing radial distance of said second component from said center.

5. A pump impeller as set forth in claim 1 wherein said drive plate is an annular disc.

6. An impeller as set forth in claim 4, wherein said top edge of said first component increases in distance from said drive plate corresponding to increasing radial distance of said first component from said center.

* * * * *